US008590613B2

(12) United States Patent
Bowersock et al.

(10) Patent No.: US 8,590,613 B2
(45) Date of Patent: Nov. 26, 2013

(54) OVERSHOT WITH DYNAMIC SEAL FEATURE

(75) Inventors: Justin C. Bowersock, Spring, TX (US); John M. Lee, Scott, LA (US); Kent A. Evans, Austin, TX (US)

(73) Assignee: Baker Hughes Incorporated, Houston, TX (US)

( * ) Notice: Subject to any disclaimer, the term of this patent is extended or adjusted under 35 U.S.C. 154(b) by 360 days.

(21) Appl. No.: 12/985,106

(22) Filed: Jan. 5, 2011

(65) Prior Publication Data

US 2012/0168147 A1 Jul. 5, 2012

(51) Int. Cl.
*E21B 31/20* (2006.01)

(52) U.S. Cl.
USPC ..... 166/98; 166/301; 294/86.12; 294/86.24

(58) Field of Classification Search
USPC ..... 166/98, 99, 301; 294/86.1, 86.12, 294/86.24, 86.34
See application file for complete search history.

(56) References Cited

U.S. PATENT DOCUMENTS

| | | | | | |
|---|---|---|---|---|---|
| 1,554,553 | A * | 9/1925 | Sumter et al. | ..... | 294/86.32 |
| 2,621,960 | A * | 12/1952 | Justice et al. | ..... | 294/86.15 |
| 2,743,130 | A * | 4/1956 | Osmun | ..... | 294/86.17 |
| 3,191,981 | A * | 6/1965 | Osmun | ..... | 294/86.31 |
| 4,052,861 | A | 10/1977 | Malone et al. | | |
| 4,368,911 | A * | 1/1983 | Pringle | ..... | 294/86.15 |
| 5,085,479 | A | 2/1992 | Taylor | | |
| 5,249,625 | A | 10/1993 | Skipper et al. | | |
| 5,413,171 | A * | 5/1995 | Womack | ..... | 166/98 |
| 6,425,615 | B1 * | 7/2002 | Mullane, Jr. | ..... | 294/86.3 |
| 7,083,209 | B2 * | 8/2006 | Leman et al. | ..... | 294/86.17 |
| 2004/0256871 | A1 | 12/2004 | Leman et al. | | |
| 2009/0084550 | A1 | 4/2009 | Korte et al. | | |
| 2010/0025035 | A1 | 2/2010 | Korte et al. | | |
| 2010/0147507 | A1 | 6/2010 | Korte et al. | | |
| 2012/0168147 | A1 * | 7/2012 | Bowersock et al. | ..... | 166/99 |

* cited by examiner

*Primary Examiner* — Jennifer H Gay
(74) *Attorney, Agent, or Firm* — Steve Rosenblatt

(57) ABSTRACT

An overshot has an articulated seal that can be set against the fish when the fish is engaged by the tool. The seal can be actuated from swelling due to exposure to well fluid or mechanically or hydraulically from the string that supports it. The use of spears or overshots with the articulated seal feature is contemplated. If a swelling design is used it can respond to water or hydrocarbons that are found at the subterranean location.

16 Claims, 2 Drawing Sheets

OVERSHOT WITH DYNAMIC SEAL FEATURE

FIELD OF THE INVENTION

The field of the invention is fishing tools for subterranean use and more particularly overshots that have an internal seal that can span a gap around the outside of the fish to sealingly engage it for pressure pumping through the fish.

BACKGROUND OF THE INVENTION

During the conduct of operations in a borehole a tool or a tubular string can get stuck and needs to be worked free. Tools that wash over the stuck tool that is also known as a fish are called overshots. These tools have a low end opening that accepts the upper end of the stuck fish. There is a gripping device in the overshot to engage the fish. One type of such gripping device is a thread form that digs into the fish as the overshot is turned to the right. As the string supporting the overshot is turned to the right with weight set down it digs a thread pattern into the fish so that when the rotation is stopped and the set down force is removed in favor of a pickup force, the fish is then subjected to the pickup force and will hopefully release so that it can be brought out of the wellbore.

In the past, overshots had a fixed seal mounted in the receptacle for the fish with the idea that the seal would engage the outside diameter of the fish and make a seal. One such tool is the High Pressure Packoff sold by Baker Oil Tools under the Product Family number H11059. The problems arose when the gap to the fish was sufficient that the internal seal in the overshot could not effectively seal against the body of the fish to deliver pumped pressure into the fish. This could happen for a variety of reasons. One reason is simply the availability at the location of a choice of overshots that have a variety of seal sizes and the resulting dimensional mismatch between the available seal in the overshot and the exterior dimensions of the fish. Another issue could be the condition of the exterior surface of the fish at the top where the overshot drops down on the fish. The exterior surface of the fish could have scale or burrs or could be out of a rounded shape, to cite a few examples.

One attempt to seal a fish in an overshot is shown in U.S. Pat. No. 4,052,861 where an inflatable pushes out collet heads with grip surfaces on a side facing the fish to try to hold the fish. While this design looks like it might work on paper the reality is that a pulling force on the overshot will distort the inflatable until one end of the inflatable will come loose from its seal against the inner housing wall. While the inflatable in this design is intended to push the collets to grip and seal where it contracts the fish the inflatable design is very weak structurally and lends no meaningful support to the collet heads under pulling loads so that a release from the fish is likely. A separate control or fill line is also needed to inflate which takes up space and precludes use of the tool in smaller boreholes.

The present invention offers an articulated seal that can handle a range of shapes and sizes at the top of the fish and allows for a clearance for fast engagement and a subsequent actuation of the seal to close a wide range of gaps with a pressure seal that will allow pumping into the fish to actuate a pressure responsive component on the fish or that will allow circulation or reverse circulation through the fish. In the preferred embodiment a swelling material that is responsive to hydrocarbons or water or both can be used as the seal. Mechanically or hydraulically actuated seals are also contemplated. Those skilled in the art will have a better understanding of the invention from a review of the description of the preferred embodiment and the associated drawings while recognizing that the full scope of the invention is to be determined from the appended claims.

SUMMARY OF THE INVENTION

An overshot has an articulated seal that can be set against the fish when the fish is engaged by the tool. The seal can be actuated from swelling due to exposure to well fluid or mechanically or hydraulically from the string that supports it. The use of spears or overshots with the articulated seal feature is contemplated. If a swelling design is used it can respond to water or hydrocarbons that are found at the subterranean location.

DETAILED DESCRIPTION OF THE PREFERRED EMBODIMENT

Figure 2:
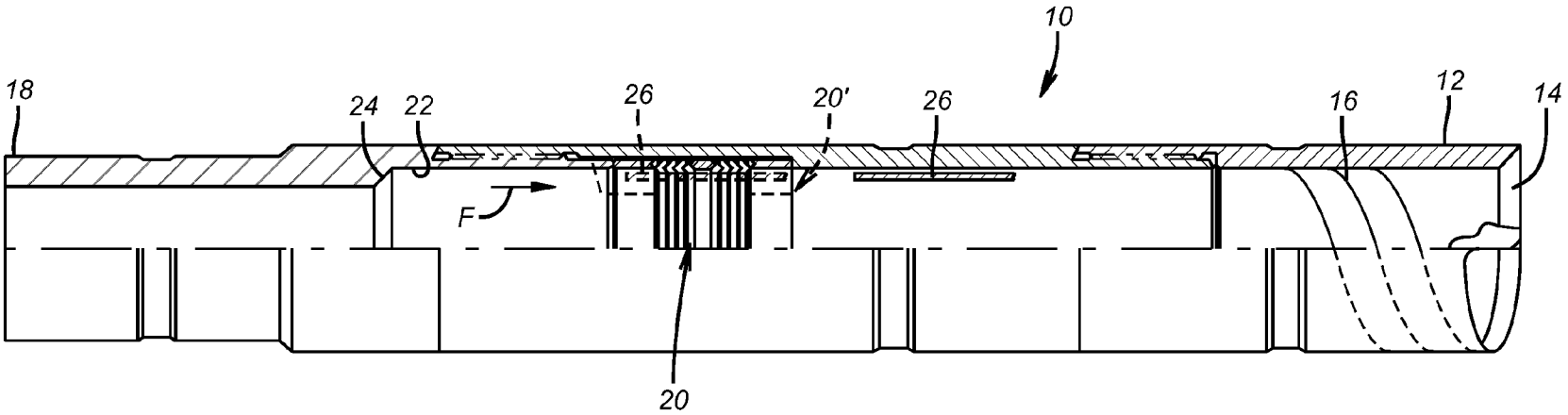
FIG. 2 represents a modified version of the overshot of FIG. 1 where the seal in the overshot housing can be articulated to close a gap against the fish in a variety of fish sizes and conditions.
Figure 3:
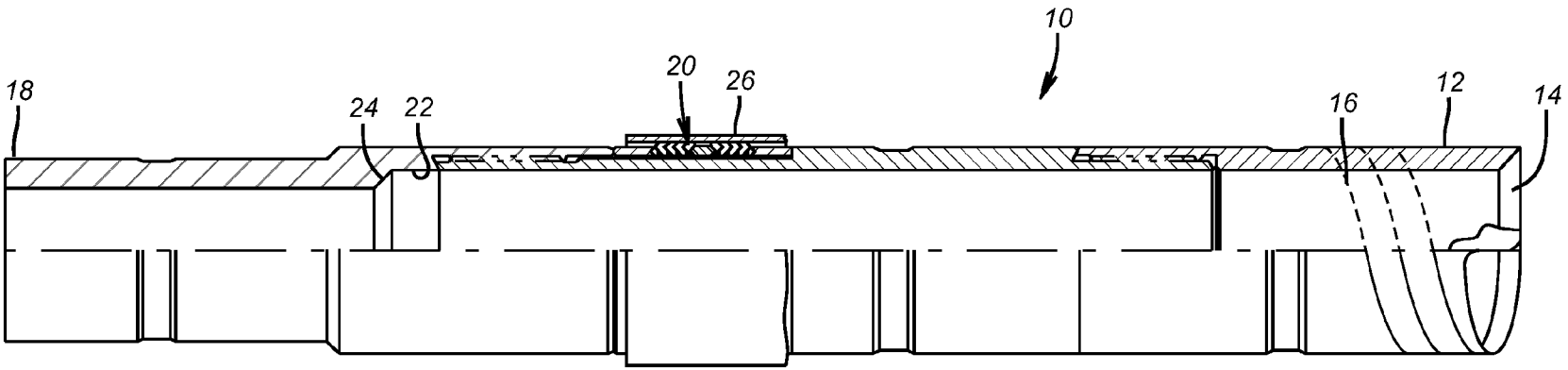
FIG. 3 is a spear version of the overshot in FIG. 2.

As shown in the FIG. 2 the overshot 10 has an elongated tubular body 12 with a lower end opening 14 which accepts the fish. An internal thread form 16 is preferably made of a hardened material so that rotation of the body 12 using a string (not shown) that is connected at the upper end 18 will result in cutting a similar thread form in the fish so that the body 12 can mechanically engage the fish for force transmission in the axial direction and in rotation.

Figure 1:
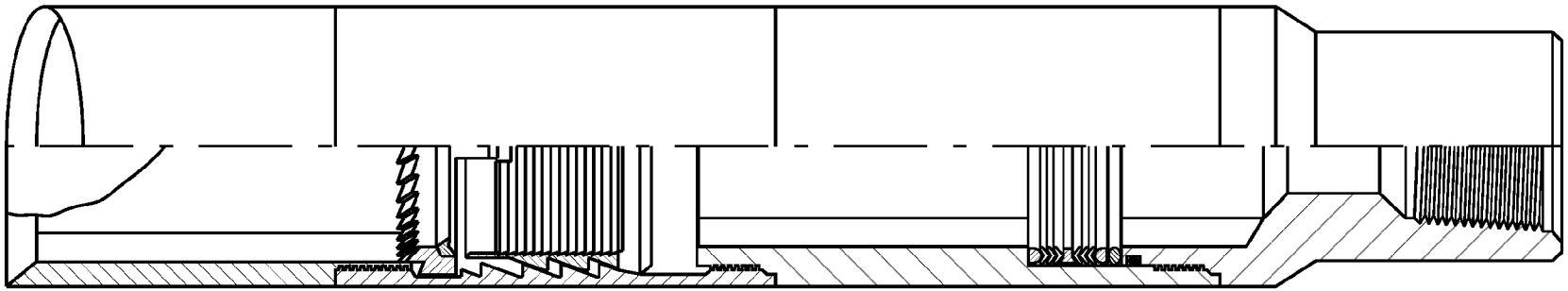
(PRIOR ART) FIG. 1
FIG. 1 is a view of a prior art tool with a fixed dimension seal designed to seal on a fish of a predetermined dimension under ideal shape conditions for the fish.

Mounted internally to the body 12 is a seal assembly 20 mounted in the recess 22. Dashed lines 20' are intended to show the set position of the seal assembly 20 which has it moving radially to an engaged relation with the fish body that has advanced into the opening 14 and up to internal shoulder 24. The seal assembly 20, 20' is the distinguishing feature of the present invention as compared to the known design in FIG. 1

The seal 20 can be a swelling material that is responsive to well fluids that are either present in the wellbore or thereafter added to the wellbore to initiate the swelling. The material can responsive to hydrocarbons or water. Such materials are described in US Publication 2010/0147507 and can have a cover that regulates the swelling rate to allow time to get to latch onto the fish before significant expansion begins as described in US Publication 2010/0025035. Water swellable compounds are also described in detail in US Publication 2009/0084550. The use of a swellable material allows a given size of seal 20 to swell to a sealing position at 20' and span a variable gap depending on the fish configuration while still allowing a sealing contact so that pressure down the housing 12 from end 18 can be communicated to the fish to either operate a pressure actuated assembly on the fish with the hope of an assist in dislodging it or to allow circulation or reverse circulation through the fish and the body 12 again with the intent of breaking the fish loose so that it can be retrieved.

Another option for the articulated seal is to actuate the seal when over the fish with moving a sleeve. The sleeve can be mechanically actuated such as with a j-slot that is actuated by alternative raising and lowering the body 12 that can have relatively movable components so that after a predetermined number of cycles while on the fish the seal can deploy around the fish and can be locked in that position or selectively released if needed. Alternatively a ball seat on a sleeve can be used to land a ball and pressure up to shift the sleeve to actuate the seal around the fish. These alternative ways to actuate a seal are schematically represented by the arrow F in the FIG. 2 The ball can be blown through the seat after the seal is set to allow flow through the body 12 if desired.

Those skilled in the art will appreciate that the seal assembly is supported from the overshot body and engages the fish directly at a time when the grip device already retains the fish. This prevents axial loads on the engaged seal when extended to seal against the fish. The operation of retaining the fish and sealing against the fish are via separate structures that are preferably not interdependent.

The use of a retracted seal that is in a recess in the housing allows the seal to be protected against burrs on the fish as the fish is acquired. Using a swelling element also still yields a seal even if a burr on the fish removes a part of the seal as the fish is acquired. Another option can be a protective sleeve shown schematically as 26 over the seal for run in that is displaced, dissolved or disintegrated when setting down weight or rotating to grab the fish or upon exposure to well fluids or fluids later added to the well. The seal is then protected until it is located around the fish at which time the seal first becomes exposed for swelling to a sealing position or being forced mechanically or hydraulically to a sealing position.

While an overshot is a preferred embodiment a spear that grabs a fishing groove can also be adapted to use the articulated seal whether swelling or otherwise initiated so that some fluid pressure can be delivered into the fish even if a spear that grabs with abutting collet fingers is used and some leakage among the fingers is encountered.

The above description is illustrative of the preferred embodiment and many modifications may be made by those skilled in the art without departing from the invention whose scope is to be determined from the literal and equivalent scope of the claims below.

We claim:

1. A fishing tool for subterranean use to engage a fish for release thereof, comprising;

a housing;

a gripping assembly to selectively grab the fish and hold the fish against relative axial movement in said housing;

an articulated seal assembly operable independently of said gripping assembly from a first position where said housing and said fish fully overlap and said seal does not contact the fish to a second position where said seal assembly moves into sealing contact with the fish; and said gripping assembly gripping the fish to prevent relative movement between said housing and the fish before said second position is reached.

2. The tool of claim 1, wherein:

said seal articulates by swelling.

3. The tool of claim 2, wherein:

said seal swells in the presence of hydrocarbons.

4. The tool of claim 2, wherein:

said seal swells in the presence of water.

5. The tool of claim 2, wherein:

said seal is covered by a removable cover for run in.

6. The tool of claim 5, wherein:

said cover is shifted in said housing to expose said seal.

7. The tool of claim 5, wherein:

said cover dissolves or disintegrates to expose said seal.

8. The tool of claim 2, wherein:

said seal compensates for surface irregularities or out of roundness of the fish by taking the shape of the fish when swelling.

9. The tool of claim 2, wherein:

said seal remains functional to swell to a seal against the fish despite being cut by a jagged end of the fish.

10. The tool of claim 2, wherein:

said swelling occurs in response to exposure to subterranean fluids or fluids added to the subterranean location.

11. The tool of claim 1, wherein:

said seal articulated by mechanical compression.

12. The tool of claim 1, wherein:

said seal articulated with applied pressure in said housing.

13. The tool of claim 1, wherein:

said gripping assembly and said seal are located within said housing.

14. The tool of claim 1, wherein:

said gripping assembly and said seal are located exterior to said housing.

15. The tool of claim 1, wherein:

said seal directs pressure delivered into said housing to the fish.

16. The tool of claim 1, wherein:

said seal is mounted in an enlarged portion of a passage through said housing to protect said seal from damage as the fish is engaged to said housing.

* * * * *